United States Patent [19]

DeKraker et al.

[11] Patent Number: 5,056,863

[45] Date of Patent: Oct. 15, 1991

[54] LATERALLY ADJUSTABLE ARMREST FOR A CHAIR

[75] Inventors: Larry DeKraker, Holland; Thomas R. Demmon, Grand Rapids; James P. Steffens, Hopkins, all of Mich.

[73] Assignee: Steelcase Inc., Grand Rapids, Mich.

[21] Appl. No.: 447,001

[22] Filed: Dec. 6, 1990

Related U.S. Application Data

[63] Continuation-in-part of Ser. No. 418,837, Oct. 10, 1989.

[51] Int. Cl.[5] ..... A47C 7/54

[52] U.S. Cl. ..... 297/411; 403/3; 248/297.3

[58] Field of Search ..... 297/44, 412; 248/298, 248/297.3; 403/3, 4

[56] References Cited

U.S. PATENT DOCUMENTS

| | | | |
|---|---|---|---|
| 1,259,310 | 3/1918 | Starker | 403/3 X |
| 1,462,240 | 7/1923 | Moss | 248/297.3 |
| 2,549,902 | 4/1951 | Hibbard et al. | 297/411 X |
| 4,822,103 | 4/1989 | Stenvall | 297/411 |

*Primary Examiner*—Peter A. Aschenbrenner

*Attorney, Agent, or Firm*—Price, Heneveld, Cooper, DeWitt & Litton

[57] ABSTRACT

A laterally adjustable armrest assembly for a chair includes an armrest support adapted to be secured to the chair. A bracket is joined to an upper end of the armrest support. An armrest member defines a plurality of downwardly opening grooves dimensioned to receive the bracket in selectively adjustable lateral positions.

11 Claims, 4 Drawing Sheets

LATERALLY ADJUSTABLE ARMREST FOR A CHAIR

CROSS REFERENCE TO RELATED APPLICATION

This is a continuation-in-part of copending U.S. Application Ser. No. 07/418,837 filed Oct. 10, 1989.

BACKGROUND OF THE INVENTION

The present invention relates to furniture and more particularly to a chair having unique, laterally adjustable armrest assemblies.

A wide variety of task chairs adapted for the office environment are presently available. Such chairs include various adjustments to adapt them to the particular user and task. The chairs may, for example, include vertically adjustable seat height mechanisms, swivel/tilt mechanisms and adjustable back height mechanisms. Office chairs may be provided with arm assemblies. Heretofore, such chairs have had a fixed width between the armrests. The chairs have not been readily adaptable to different users.

A need exists for an armrest assembly for a chair which permits lateral adjustment of the width between the armrests.

SUMMARY OF THE INVENTION

In accordance with the present invention, the aforementioned need is met. Essentially, a laterally adjustable armrest assembly is provided which includes an armrest support and an armrest Adjustment means between the support and the armrest permit selective, lateral adjustment or transverse adjustment of the armrest with respect to the support. As a result, the user may position the armrests at differing widths to more readily accommodate the individual and adapt the chair to a particular task.

DETAILED DESCRIPTION OF THE PREFERRED EMBODIMENT

Figure 1:
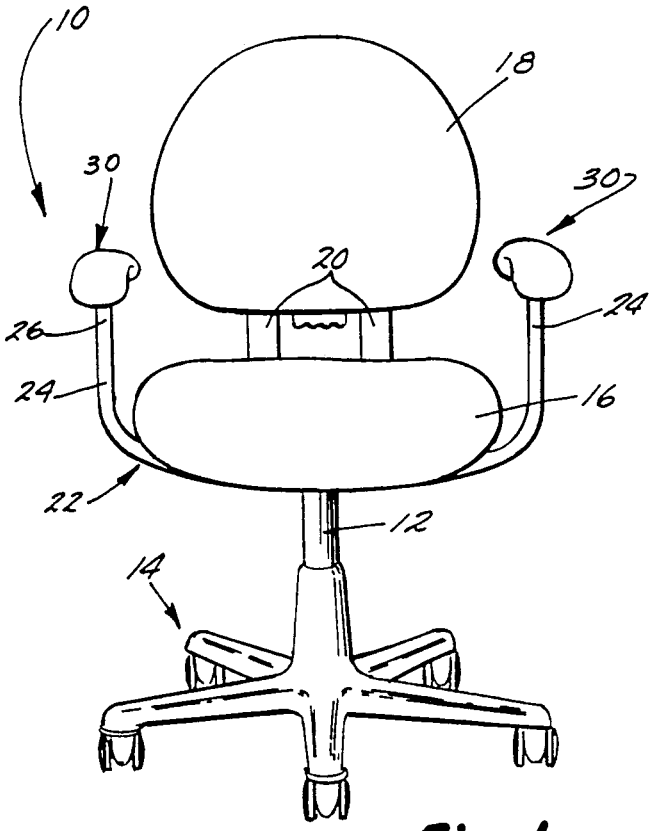
FIG. 1 is a front, elevational view of a chair in accordance with the present invention.

A chair including laterally adjustable armrest assemblies in accordance with the present invention is illustrated in FIG. 1 and generally designated by the numeral 10. Chair 10 includes a support pedestal 12 mounted on a castered base 14. A seat 16 is mounted on pedestal 12 by a suitable chair control (not shown). A chair back 18 is also mounted on pedestal 12 by the chair control and by suitable supports 20. In a conventional fashion, a mechanism may be included for adjusting the vertical height of seat 16 with respect to base 14. In addition, a chair back adjustment mechanism may also be included for positioning the seat back 18 with respect to the seat 16.

Chair 10 further includes a generally U-shaped, tubular armrest support 22 defining generally vertically extending support portions or members 24. Members 24 extend vertically adjacent lateral sides of seat 16.

Figure 2:
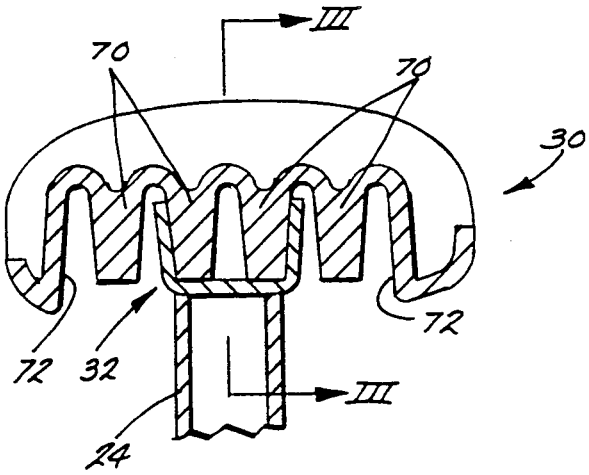
FIGS. 2 and 2*a* are transverse cross sectional views showing the armrest in two different lateral positions.
Figure 3:
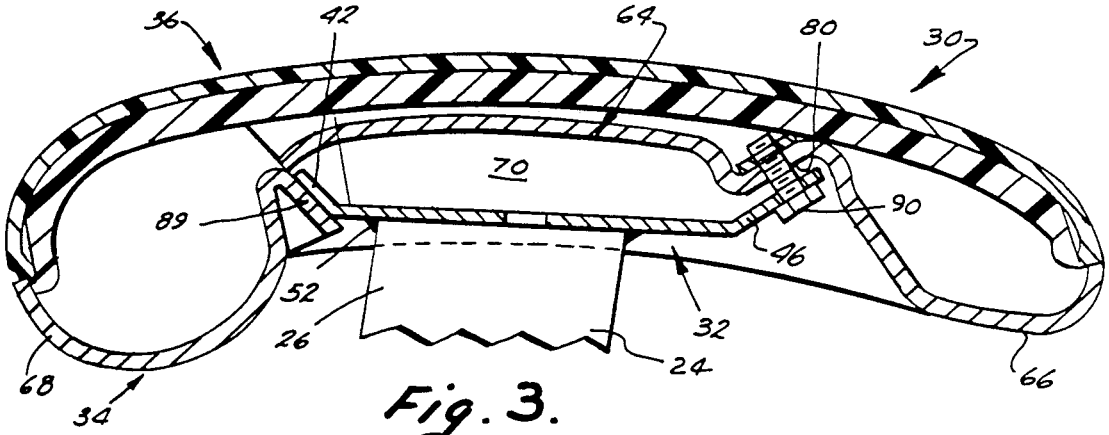
FIG. 3 is a cross sectional view taken generally along line III—III of FIG. 2.
Figure 4:
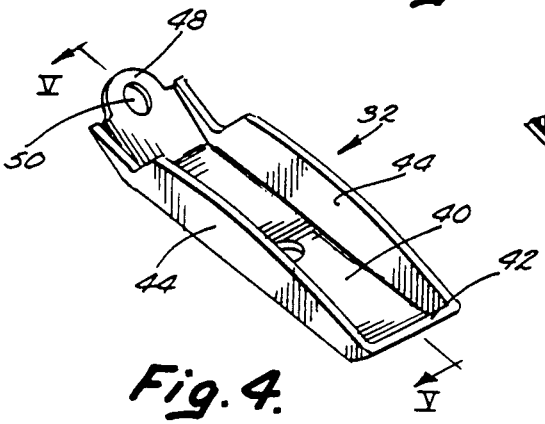
FIG. 4 is a perspective view of a bracket incorporated in the present invention.
Figure 5:
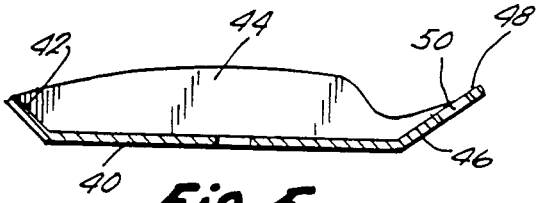
FIG. 5 is a cross sectional view taken generally along line V—V of FIG. 4.
Figure 6:
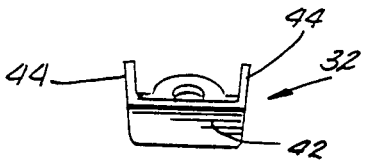
FIG. 6 is a right end elevational view of the bracket of FIG. 4.
Figure 7:
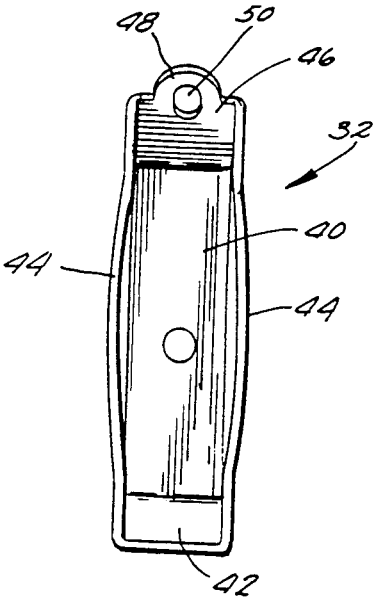
FIG. 7 is a top, plan view of the bracket.

Mounted on upper ends 26 of support members 24 are armrest assemblies 30 in accordance with the present invention. As shown in FIGS. 2 and 3, each armrest assembly 30 includes a mounting bracket 32, a lower armrest member 34 and an upper armrest member 36. Upper armrest member 36 may be a soft or upholstered unit or a rigid plastic unit which is joined to lower member 34. In the alternative, members 34, 36 could be integrally formed.

As seen in FIGS. 4–7, bracket 32 is a generally elongated member having a U-shaped cross section. Bracket 32 includes a base 40, an angled end 42 and upwardly extending elongated sides or walls 44. Walls 44 are joined at the end opposite portion 42 by an upwardly and acutely angled tongue 46. Tongue 46 defines a generally semi-circular tab or ear portion 48 having an aperture 50. As shown in FIGS. 2 and 3, bracket 32 is secured in a suitable fashion to upper end 26 of support member 24, such as by a weld 52.

Figure 12:
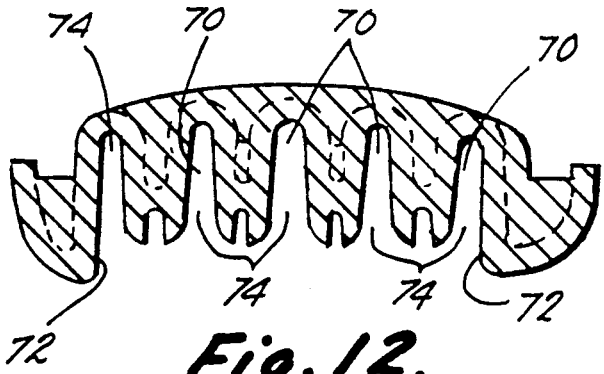
FIG. 12 is a cross sectional view taken generally long line XII—XII of FIG. 8.
Figure 11:
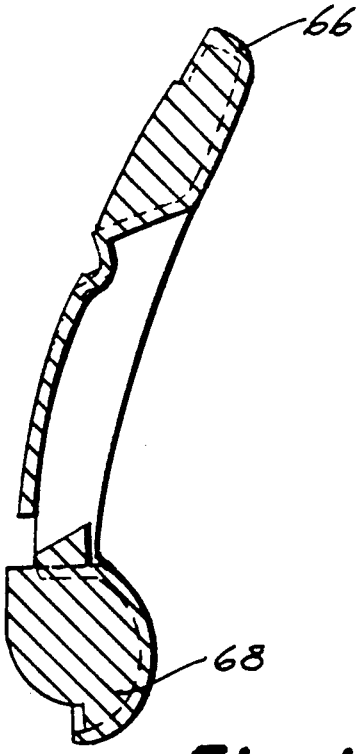
FIG. 11 is a cross sectional view taken generally along line XI—XI of FIG. 8.

Lower armrest member 34 is best shown in FIGS. 8–12. Member 34 has an elongated configuration and defines an undersurface 62. Member 34 includes a central portion 64 and ends 66, 68. Central portion 64 defines or includes a plurality of longitudinally extending, spaced parallel ribs 70 and side walls 72. The ribs 70 and side walls 72 as seen in FIGS. 2 and 12 define grooves 74. Grooves 74 open downwardly through the lower surface of member 34.

Figure 8:
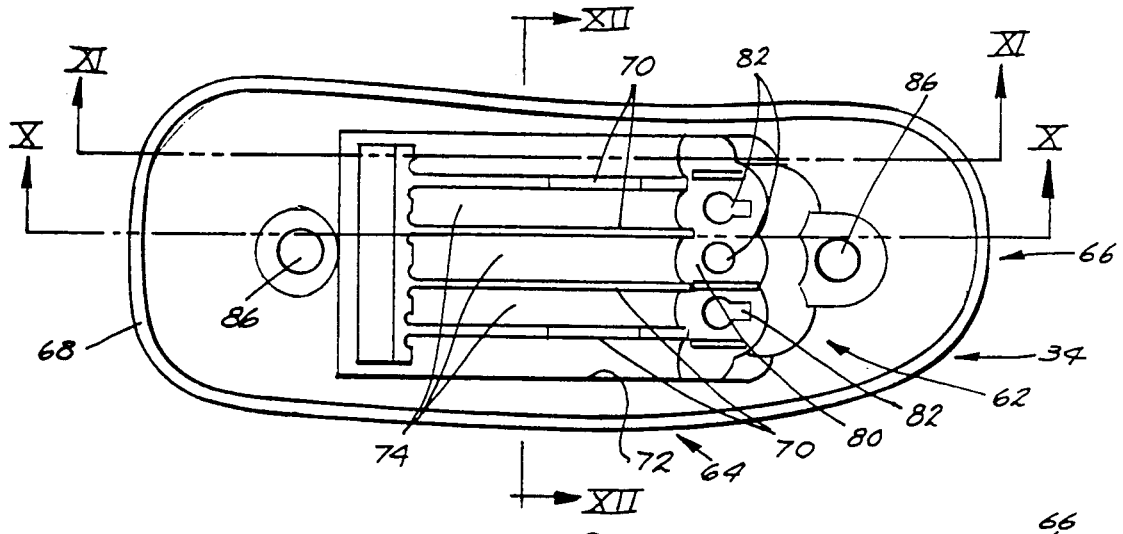
FIG. 8 is bottom view of an armrest member incorporated in the present invention.
Figure 9:
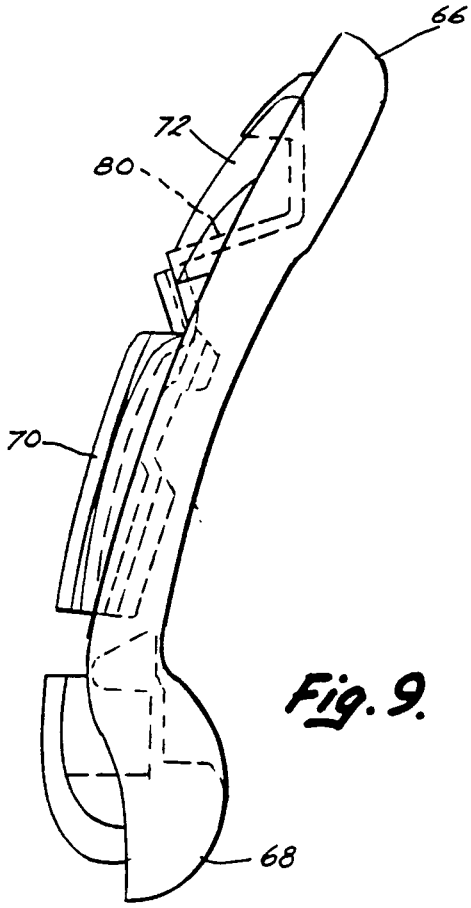
FIG. 9 is a right side, elevational view of the armrest member of FIG. 8.
Figure 10:
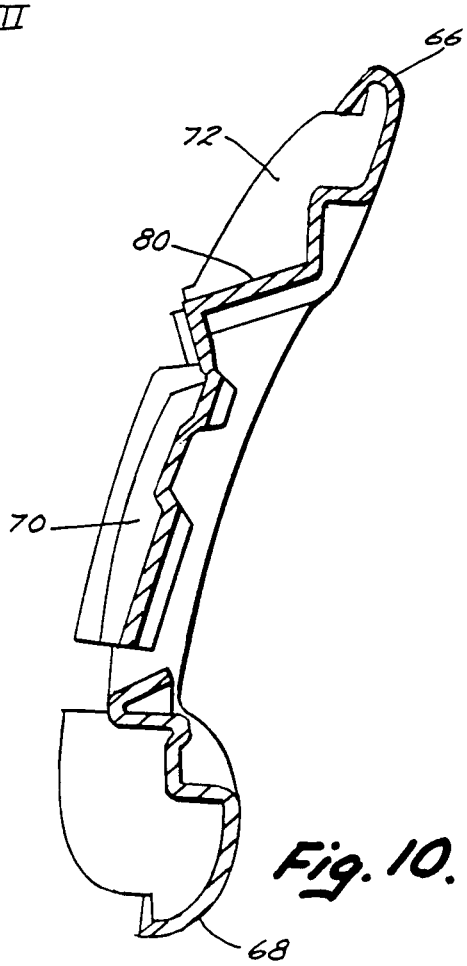
FIG. 10 is a cross sectional view taken generally along line X—X of FIG. 8.

A downwardly angled surface 80 extends transversely of ribs 70 towards end 66. Surface 80 is formed with a plurality of apertures 82. As seen in FIG. 8, apertures 82 are formed along the longitudinal center lines of grooves 74. Forward portion 68 of the armrest defines a ramp 89 (FIG. 3). Ramp 89 cooperates with bracket 32 as described below. In addition, the undersurface of member 34 may define attachment apertures 86. Apertures 86 serve as attachment points for upper armrest member 36. As seen in FIG. 3, armrest member 34 is secured to bracket 32 by a suitable fastener 90 extending through aperture 50 in bracket 32 and into one of the apertures 82.

Figure 2A:
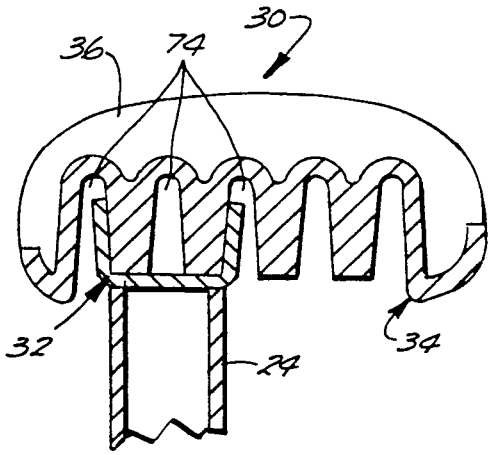

In order to adjust armrest member 34 transversely or laterally with respect to bracket 32 and armrest support 24, fastener 90 is initially removed. Member 34 may then be lifted off of the bracket and moved laterally until side walls 44 are positioned in a selected pair of the grooves 74. Movement of the armrest from a centered position to a outward position is illustrated in FIGS. 2 and 2*a*. When positioned in the desired location, fastener 90 is reinserted. The fastener 90 will draw the complementary angled surfaces of tongue 46 and surface 80 of member 34 towards each other into a mating relationship. The fastener, therefore, also wedges ramp 89 into angled end 42 of bracket 32 thereby locking the front of armrest 3 in position. The fastener 90 tightens the armrest member 34 to the bracket 32 and hence to support 24. The elongated nature of the bracket 32 and the elongated nature of the grooves 74 securely retain the armrest member 34 and prevent rotational movement or shifting about a vertical axis. In the form illustrated, five grooves are defined. The armrest may, therefore, be positioned selectively in one of three different lateral positions with respect to the support 24. The U-shaped bracket in cross section provides adequate support to eliminate any rolling action of the armrest member about a horizontal or longitudinal axis. The armrest is retained in a positive fashion at the selected positions.

As should be readily apparent, the user may easily position the armrest assemblies 30 to increase or decrease the width between the rests with respect to the seat 16 and the supports 24 from a centered position. Chair 10 has, therefore, increased adjustability not heretofore obtained. The assembly is relatively easily manufactured employing conventional procedures. The lower armrest member 34 may be fabricated from a rigid engineering plastic material, such as a glass reinforced nylon. It is presently preferred, however, that the material be a polyphenylene oxide. Such material is commercially available under the brand name PPO or under the brandname Noryl which is sold by General Electric. Bracket 32 is preferably manufactured from steel. The armrest may, therefore, be readily molded in different configurations to suit the design considerations or appearance of the chair while readily forming the ribs and grooves which form a portion of the adjustment mechanism. The bracket may be easily stamped from steel sheet.

In view of the above description, those of ordinary skill in the art may envision various modifications which would not depart from the inventive concepts disclosed. For example, the armrest support need not be a U-shaped tubular member. Individual support members could be secured to the chair base or to the chair seat. In addition, the bracket 32 could be joined integrally to or formed as an integral part with the armrest support member. It is expressly intended, therefore, the above description should be considered as only that of the preferred embodiment The true spirit and scope of the present invention may be determined by reference to the appended claims.

The embodiments of the invention in which an exclusive property or privilege is claimed are defined as follows:

1. A laterally adjustable armrest assembly for a chair, said assembly comprising:

an armrest support adapted to be secured to a chair;

an armrest, said armrest comprising an elongated member having a plurality of longitudinally extending, spaced ribs defining a plurality of grooves; and armrest adjustment means on said support and said armrest for permitting selective lateral adjustment of said armrest with respect to said armrest support, and wherein said adjustment means comprises an elongated bracket joined to said support and having a generally U-shaped configuration in transverse cross section, said bracket including a base and generally upwardly extending side walls, said side walls disposed within selected ones of said grooves so that said armrest may be moved laterally with respect to said bracket and said support

2. An assembly as defined by claim 1 wherein said bracket defines a tongue extending between said side walls at an acute angle with respect to said base.

3. An assembly as defined by claim 2 wherein said armrest defines a downwardly angled surface extending transversely thereof, said downwardly angled surface mating with said tongue of said bracket.

4. An assembly as defined by claim 3 further including a fastener extending through said tongue and into said armrest to hold the bracket and armrest together with said tongue mating against said downwardly angled surface.

5. An assembly as defined by claim 4 wherein said armrest defines a plurality of transversely spaced apertures on said angled surface positioned for selective receipt of said fastener.

6. An assembly as defined by claim 5 wherein said elongated member defines five downwardly opening grooves permitting said member to be selectively placed in three different positions on said bracket.

7. An assembly as defined by claim 4 wherein said armrest further includes an upper armrest member joined to said elongated member.

8. A chair of the type including a base, a seat, a back on said base, and a pair of spaced armrest supports extending generally vertically adjacent the sides of said seat, each of said armrest supports having an adjustable armrest assembly mounted thereon, each of said assemblies comprising:

an elongated armrest member having an undersurface facing said support, said armrest member having a plurality of longitudinally extending, laterally spaced grooves opening through said undersurface;

lateral adjustment means between said support and said armrest member for permitting said armrest member to be selectively adjusted laterally with respect to said support and retained in position in a positive fashion so that said armrest assemblies provide a variable width therebetween, said lateral adjustment means comprising an elongated bracket joined to said support and including a tongue, a base and a pair of elongated, transversely spaced, generally parallel walls extending upwardly from said base and said support, said walls dimensioned and selectively disposed within a pair of said grooves; and a fastener selectively interconnecting said armrest member and said tongue to draw said tongue and said armrest member into mating engagement.

9. A chair of the type including a base, a seat, a back on said base, and a pair of spaced armrest supports extending generally vertically adjacent the sides of said seat, each of said armrest supports having an adjustable armrest assembly mounted thereon, said assembly comprising:

an armrest member having an undersurface facing said support;

lateral adjustment means between said support and said armrest member for permitting said armrest member to be selectively adjusted laterally with respect to said support and retained in position in a positive fashion so that said armrest assemblies provide a variable width therebetween, each armrest member defining a plurality of longitudinally extending grooves opening through said undersurface, said lateral adjustment means comprising a pair of transversely spaced, generally parallel walls extending upwardly from said support, said walls dimensioned to be selectively disposed within a pair of said grooves, and wherein said lateral adjustment means further includes an angled tongue having a surface facing said armrest member and engaging a complementary armrest member surface.

10. An assembly as defined by claim 9 wherein said armrest member defines a plurality of apertures opening through said complementary armrest surface and said adjustment means includes a removable fastener extending through said tongue and into one of said apertures to draw said member surface into mating engagement with said tongue

11. An assembly as defined by claim 10 wherein said armrest member is covered by an arm engaging upper member.

* * * * *